US006871509B2

(12) United States Patent
Grabon et al.

(10) Patent No.: US 6,871,509 B2
(45) Date of Patent: Mar. 29, 2005

(54) ENHANCED COOLING SYSTEM

(75) Inventors: Michel K. Grabon, Bressolles (FR); Xavier Girod, Montluel (FR); Kenneth J. Nieva, Murfreesboro, TN (US); Philippe Rigal, Savigneux (FR)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/262,731

(22) Filed: Oct. 2, 2002

(65) Prior Publication Data

US 2004/0065099 A1 Apr. 8, 2004

(51) Int. Cl.[7] ..... F25D 17/02

(52) U.S. Cl. ..... 62/201; 62/DIG. 2; 62/208; 62/209

(58) Field of Search ..... 62/201, DIG. 2, 62/208, 209

(56) References Cited

U.S. PATENT DOCUMENTS

| | | | | | |
|---|---|---|---|---|---|
| 2,200,215 | A | | 5/1940 | Lewis | |
| 2,892,321 | A | | 6/1959 | Kritzer | |
| 4,327,559 | A | * | 5/1982 | Spethmann | 62/179 |
| 4,926,649 | A | | 5/1990 | Martinez, Jr. | |
| 5,088,292 | A | * | 2/1992 | Champagne et al. | 62/84 |
| 5,211,029 | A | * | 5/1993 | Uselton et al. | 62/324.5 |
| 5,341,649 | A | * | 8/1994 | Nevitt et al. | 62/126 |
| 5,495,723 | A | * | 3/1996 | MacDonald | 62/183 |
| 5,626,025 | A | * | 5/1997 | Hyde | 62/117 |
| 5,819,546 | A | * | 10/1998 | Uchida | 62/141 |
| 6,023,935 | A | * | 2/2000 | Okazaki et al. | 62/119 |
| 6,047,559 | A | * | 4/2000 | Tanaka et al. | 62/476 |
| 6,250,090 | B1 | * | 6/2001 | Mei et al. | 62/155 |
| 6,279,330 | B1 | * | 8/2001 | Ueno et al. | 62/77 |

FOREIGN PATENT DOCUMENTS

| | | | |
|---|---|---|---|
| CA | 2298373 | | 8/2001 |
| FR | 2715716 | | 8/1995 |
| JP | 20000274779 | A * | 10/2000 |
| JP | 200002747774 | A * | 10/2000 |

* cited by examiner

*Primary Examiner*—William Doerrler
*Assistant Examiner*—Mohammad M. Ali

(57) ABSTRACT

An air conditioning system is disclosed which takes advantage of low ambient temperature conditions so as to activate a refrigerant flow that bypasses the compressor. The activation of the refrigerant flow is achieved by the intelligent control of a pump positioned between the outlet of the condenser and the inlet of an expansion device upstream of the evaporator. The refrigerant flow produced by the pump does not require any particular positioning of the condenser and evaporator components with respect to each other. The evaporator preferably absorbs heat from water circulating in a secondary loop which is used to remove heat from a building by one or more fan coil units.

13 Claims, 3 Drawing Sheets

ENHANCED COOLING SYSTEM

BACKGROUND OF THE INVENTION

This invention relates to the refrigerant heat exchange loop in systems which remove heat from one or more parts of a building that are to be cooled. In particular, this invention relates to the effective use of the refrigerant heat exchange loop in association with a water heat exchange loop in systems which employ water as a heat exchange medium to remove heat from various parts of a building.

It is desirable that a system for cooling one or more parts of a building be as efficient as possible. This includes minimizing the consumption of energy by the various components of the system when performing their respective functions. Various approaches have been taken to achieve this goal. These include the use of energy efficient components that minimize the consumption of electricity while performing their particular functions within the system. Examples of such components include energy efficient motors which drive compressors and/or fans within the system. Still other approaches include maximizing the efficiencies of the heat transfer mechanisms such as the evaporator and condenser elements of these systems.

Another approach to increasing system efficiency is to eliminate when possible the operation of the compressor. An example of such an approach is disclosed in U.S. Pat. No. 6,370,889. The compressor within the disclosed system in this patent is bypassed under certain conditions so as to provide a natural cooling circuit for cooling a room. The system is premised on taking advantage of gravitational flow of the more dense refrigerant as it moves to the evaporator from the condenser. Such a system however requires that the condenser be mounted above the evaporator. This system will not work in situations where the condenser unit and the evaporator unit cannot be so positioned relative to each other.

SUMMARY OF THE INVENTION

It is an object of the invention to provide a system which will eliminate, when possible, the need to use a compressor within a refrigerant loop without relying on the positioning of the condenser relative to the evaporator.

It is another object of the invention to provide a system employing water in heat exchange relationship with refrigerant in a refrigerant loop that will eliminate the need to use a compressor under favorable outside temperature conditions.

The present invention includes a system which takes advantage of low ambient temperature conditions so as to activate a refrigerant flow from condenser to evaporator while bypassing the compressor. The activation of the refrigerant flow is achieved by the intelligent control of a pump positioned between the outlet of the condenser and the inlet of an expansion device upstream of the evaporator. The intelligent control activates a bypass of the compressor while also activating the pump. The refrigerant flow produced by the pump does not require any particular positioning of the condenser and evaporator components with respect to each other. In a preferred embodiment, the evaporator absorbs heat from water circulating in a secondary loop which is used to remove heat from a building by one or more fan coil units.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
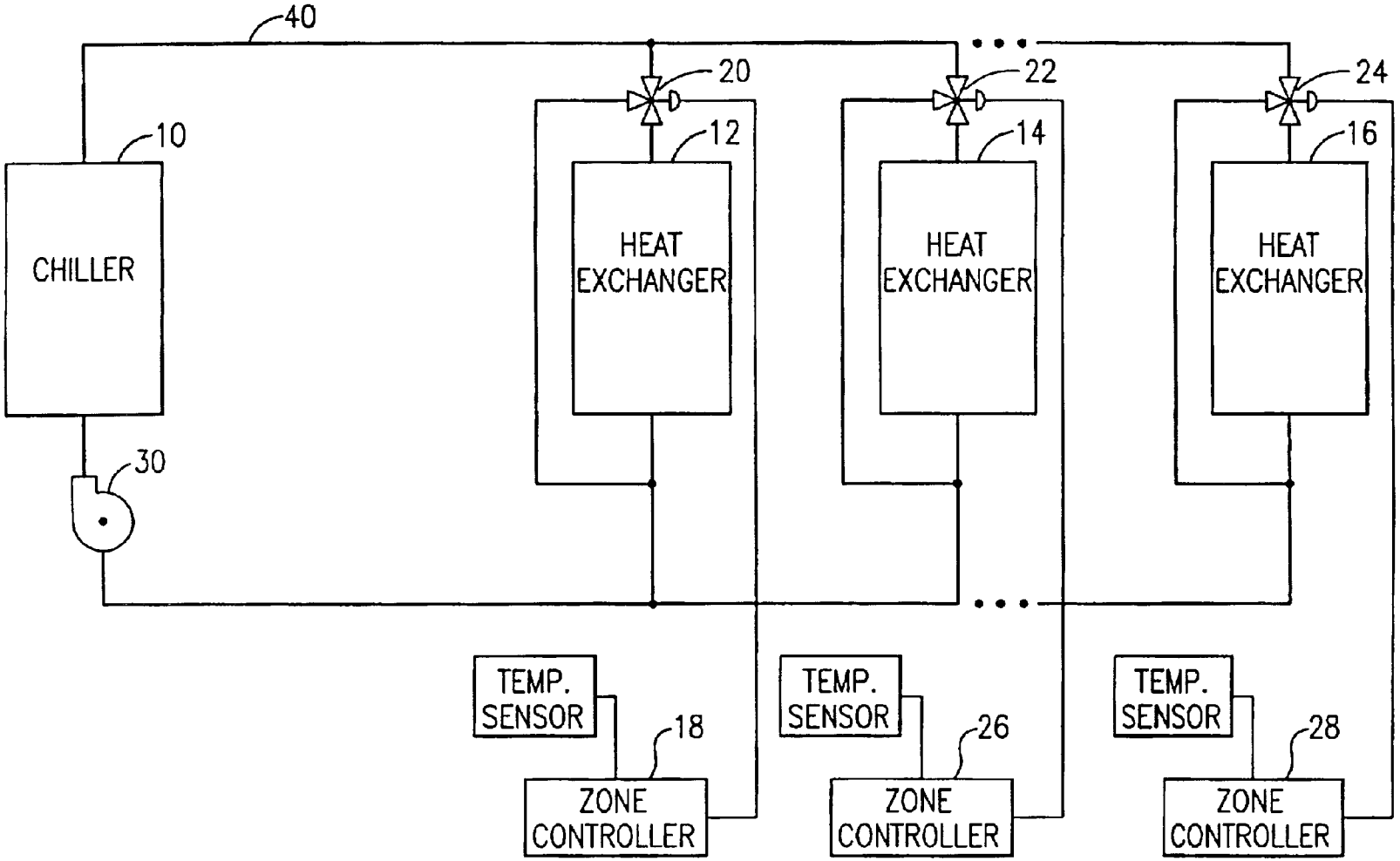
FIG. 1 is a schematic view of a system for delivering chilled water to a series of heat exchangers having zone controllers associated therewith.

Referring to FIG. 1, a chiller 10 delivers chilled water to fan coil heat exchangers 12, 14 and 16. Water from the chiller 10 flows through the fan coil heat exchanger 12 in the event that a zone controller 18 authorizes such a flow by the positioning of a control valve 20. The zone controller 18 may also divert any water flow around the fan coil heat exchanger 12 by a further positioning of the control valve 20. It is to be appreciated that the fan coil heat exchangers 14 and 16 operate in a similar fashion in response to the positioning of control valves 22 and 24 under the control of zone controller 26 and 28. Each fan coil heat exchanger conditions air flowing through the fan coil heat exchanger. The resulting conditioned air is provided to spaces to be cooled. Each space is often referred to as a "zone of cooling". It is finally to be noted that the water circulating through or around each fan coil heat exchanger is ultimately pumped back into the chiller 10 by a water pump 30 when the chiller 10 has been activated.

Figure 2:
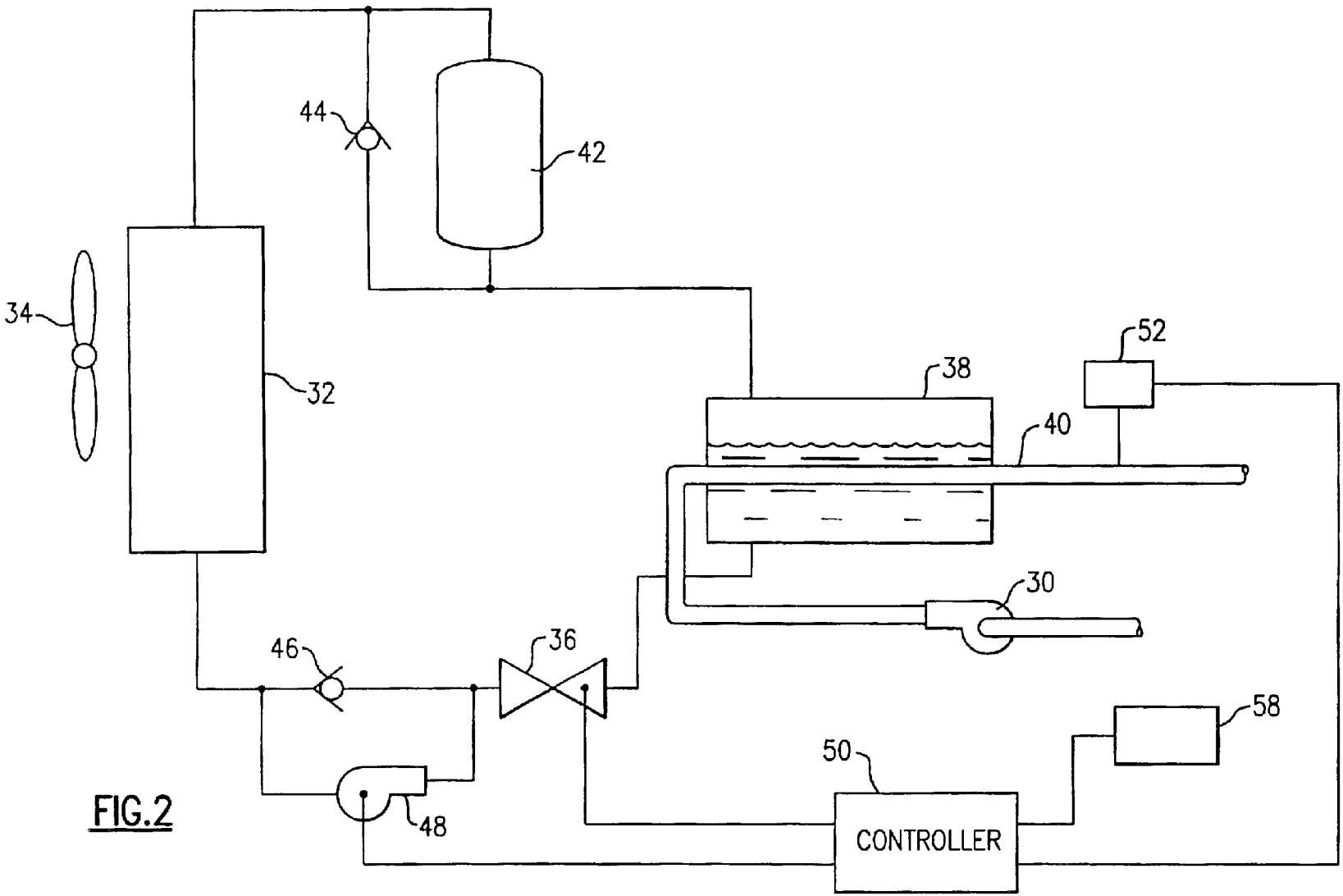
FIG. 2 is a schematic diagram of the chiller within the system of FIG. 1.

Referring now to FIG. 2, the chiller 10 is seen to include a condenser 32 having a fan 34 associated therewith. The heat of condensation of the hot refrigerant vapor refrigerant passing through the condenser 32 is removed by the flow of air produced by the fan 34. This produces high pressure sub cooled liquid refrigerant at the outlet end of the condenser 32. This high pressure sub cooled liquid refrigerant flows into a thermal expansion device 36 and is discharged at a lower pressure. The thermal expansion device is preferably an electronically controlled expansion valve, but may under certain circumstances also be a fixed orifice valve or a thermal expansion valve. The refrigerant thereafter enters an evaporator 38. The liquid refrigerant in the evaporator will extract heat from water circulating in one or more pipes immersed in the liquid refrigerant within the evaporator. The circulating water in the one or more pipes in the evaporator is the water that has been returned from the fan coil heat exchangers 12, 14, and 16 via the pump 30. The resulting chilled water leaves the evaporator 38 and is returned to the fan coil heat exchangers via an outlet line 40. On the other hand, low pressure refrigerant vapor from the evaporator is normally directed to the suction inlet of a compressor 42. The compressor 42 compresses the refrigerant vapor that is thereafter discharged to the condenser 32.

Referring again to the compressor 42, a check valve 44 is positioned between the inlet and the outlet of the compressor. Another check valve 46 is positioned between the outlet of the condenser 32 and the inlet of the expansion valve 36. A refrigerant pump 48 is furthermore positioned between the outlet of the condenser 32 and the inlet to the expansion device 36. The refrigerant pump may be either of the fixed speed or variable speed type and should be appropriately sized for the refrigerant flow requirements of the particular chiller.

The refrigerant pump 48 and the expansion device 36, when an electronically controlled expansion valve, are controlled by a controller 50. The controller also receives various sensed temperatures. In this regard, the controller receives the temperature of the chilled water leaving the evaporator 38 from a water temperature sensor 52 installed in the outlet line 40. The controller also receives the temperature of the outdoor ambient temperature from a sensor 58. As will be explained in detail hereinafter, the controller 50 is operative to activate the refrigerant pump 48 whenever the temperature of the chilled water leaving the evaporator is greater than the outside air temperature. The resulting flow of refrigerant is through the check valve 44 thus bypassing the compressor 42. The check valve 46 also assures that the refrigerant is recirculated through the refrigerant pump 48.

Figure 3:
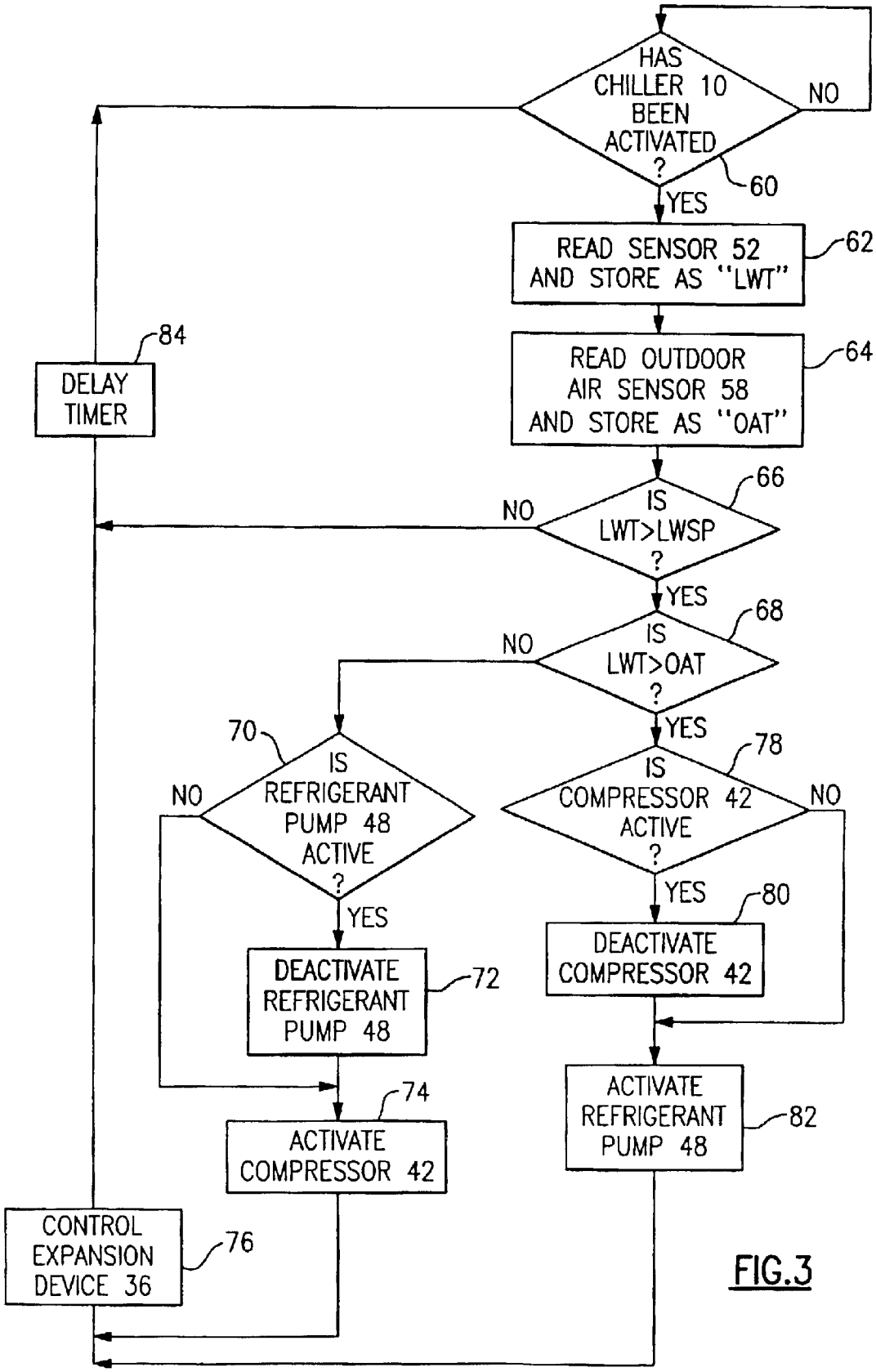
FIG. 3 is a flow chart of a method used by a controller for the chiller of FIG. 2 to bypass the compressor by activating a refrigerant pump within the refrigerant loop of the chiller.

Referring now to FIG. 3, a process utilized by a programmable processor within the controller 50 is illustrated. The process begins with a step 60 that inquires as to whether the chiller 10 has been activated. It is to be appreciated that the chiller will have been activated when the controller 50 receives demands for chilled water from one or more of the zone controllers. When the chiller is activated, the pump 30 will begin circulating water through the evaporator 38.

The processor within the controller 50 will proceed to step 62 as long as the chiller remains activated. The processor will either directly read the leaving water temperature sensor 52 in step 62 or it will note a previous reading of this temperature sensor and set the same equal to the variable "LWT". The processor will next proceed to step 64 and do the same reading, or noting of a previous reading, of the outdoor ambient temperature as sensed by outdoor temperature sensor 58.

The processor within the controller 50 will now proceed to a step 66 and inquire as to whether leaving water temperature, LWT, is greater than the leaving water setpoint "LWSP" as previously defined for the chiller 10. When this occurs, the processor proceeds to step 68 and inquires as to whether leaving water temperature, LWT, is greater than the outdoor air temperature, OAT. If LWT is not greater than OAT, then the processor will proceed to step 70 and inquire as to whether the refrigerant pump 48 is active. If the refrigerant pump is active, then the processor will proceed to step 72 and deactivate the refrigerant pump. When the refrigerant pump 48 is not active, the processor will proceed from either step 70 or step 72 to step 74 and activate the compressor 42. Activation of the compressor 42 will initiate the normal compression of refrigerant as has been previously explained. The processor within the controller will in a step 76 also initiate the control of the expansion device 36 when it is an electronically controlled expansion valve. The control defines the appropriate refrigerant flow to the evaporator 38.

Referring again to step 68, in the event that LWT is greater than OAT, then the processor will proceed to step 78 and inquire as to whether the compressor 42 is active. In the event that the compressor is active, the processor will proceed to step 80 and deactivate the compressor. When the compressor is not active, the processor will proceed out of either step 78 or step 80 to a step 82 and activate the refrigerant pump 48. As has been previously noted, this will cause refrigerant to flow through the check valve 44 instead of the compressor 42. The refrigerant will hence circulate directly into the condenser where the heat of condensation of the refrigerant will be extracted by the low outdoor ambient temperature. The check valve 46 assures that the refrigerant from the outlet of the condenser will be pumped by the refrigerant pump 48 to the inlet of the expansion valve 36. The refrigerant expands through the expansion device 36 under the control of the processor in step 76 when the same is an electronically controlled expansion valve before entering the evaporator 38.

Referring again to step 72, the processor will exit this step and proceed to a step 84 where a suitable delay will occur before again proceeding to step 60 to determine whether the chiller is still activated. It is to be noted that the processor within the controller 50 will also proceed out of step 76 to implement the delay of step 84 before proceeding to step 60. It is thus to be appreciated that the controller will be operative to either have initiated compression of the refrigerant if LWT is less than LWSTP and LWT is equal to or greater than OAT. On the other hand, the controller will not initiate the compressor if LWT is less than OAT. In this latter case, the pump 48 in combination with the check valves 44 and 46 will initiate an alternative refrigerant flow to remove the heat from the circulating water.

It is to be appreciated that a preferred embodiment of the invention has been disclosed. Alterations or modifications may occur to one of ordinary skill in the art. For instance, the control algorithm executed by the controller 50 could require that LWT is greater than OAT by some predefined amount that would assure enough temperature difference at the condenser to remove the heat of condensation.

It will be appreciated by those skilled in the art that further changes could be made to the above-described invention without departing from the scope of the invention. Accordingly, the foregoing description is by way of example only and the invention is to be limited only by the following claims and equivalents thereto.

What is claimed is:

1. A system for cooling one or more parts of a building, said system including a refrigerant circuit having a condenser with an outlet, compressor, expansion device having an inlet, and an evaporator with and inlet and outlet for chilling a medium having a heat exchange relationship with refrigerant circulating in the refrigerant circuit, said system further comprising:

a refrigerant pump having an inlet, said pump positioned downstream of the outlet of said condenser and upstream of the inlet to said evaporator a control for activating said refrigerant pump when a sensed outdoor temperature is less than a sensed temperature of the medium having the heat exchange relationship with the refrigerant; and a check valve positioned upstream of said expansion device so as to prevent the refrigerant from said condenser from directly entering the expansion device when said refrigerant pump is activated.

2. The system of claim 1 further comprising:

a check valve located between the inlet and the outlet of said compressor, said cheek valve being operative to cause the refrigerant to bypass the compressor when said refrigerant pump is activated.

3. The system of claim 1 wherein the inlet of said refrigerant pump is positioned between the outlet of said condenser and said check valve positioned upstream of said expansion device so as to receive the refrigerant from said condenser and thereafter pump the refrigerant to the inlet of said expansion device when the refrigerant pump is activated.

4. The system of claim 1 wherein said refrigerant pump is positioned between the outlet of said condenser and the inlet of said expansion device so as to allow the refrigerant being pumped from said refrigerant pump to be expanded before entering the inlet of said evaporator.

5. The system of claim 1 wherein the medium having a heat exchange relationship with the refrigerant is water circulating through said evaporator, said system further comprising:

at least one heat exchanger downstream of the outlet of said evaporator for receiving the water circulating through said evaporator so as to cool one or more parts of the building.

6. The system of claim 5 wherein said at least one heat exchanger downstream of the outlet of said evaporator is a fan coil unit having a coil containing the circulating water for conditioning air passing over the coil.

7. The system of claim 1 wherein the medium having a heat exchange relationship with the refrigerant is water circulating through said evaporator, said system further comprising:

a sensor, mounted in piping carrying the water away from the evaporator, said sensor being operative to sense the temperature of the water leaving the evaporator and to provide the temperature sensed to the controller as the sensed temperature.

8. A cooling system including a refrigerant circuit having a condenser with an outlet, an expansion device having an inlet, and an evaporator, having an inlet and an outlet, for chilling a medium having a heat exchange relationship with the refrigerant circulating in refrigerant circuit, said system further comprising:

a refrigerant pump having an inlet, said pump positioned downstream of the outlet of said condenser and upstream of the inlet to said evaporator a control for activating said refrigerant pump when a sensed outdoor temperature is less than a sensed temperature of the heat exchange medium having the heat exchange relationship with the refrigerant; and a check valve positioned upstream of said expansion device so as to prevent the refrigerant from said condenser from directly entering the expansion device when said refrigerant pump is activated.

9. The cooling system of claim 8 wherein the inlet of said refrigerant pump is positioned between the outlet of said condenser and said check valve positioned upstream of said expansion device so as to receive the refrigerant from said condenser and thereafter pump the refrigerant to the inlet of said expansion device when the refrigerant pump is activated.

10. The cooling system of claim 8 wherein said refrigerant pump is positioned between the outlet of said condenser and the inlet of said expansion device so as to allow the refrigerant being pumped from said refrigerant pump to be expanded before entering the inlet of said evaporator.

11. The cooling system of claim 8 wherein the medium having a heat exchange relationship with the refrigerant is water circulating through said evaporator, said cooling system further comprising:

at least one heat exchanger downstream of the outlet of said evaporator for receiving the water circulating through said evaporator so as to cool one or more parts of a building.

12. The cooling system of claim 11 wherein said at least one heat exchanger downstream of the outlet of said evaporator is a fan coil unit having a coil containing the circulating water for conditioning air passing over the coil.

13. The cooling system of claim 8 wherein the medium having a heat exchange relationship with the refrigerant is water circulating through said evaporator, said cooling system further comprising:

a sensor, mounted in piping carrying the water away from the evaporator, said sensor being operative to sense the temperature of the water leaving the evaporator and to provide the temperature sensed to the controller as the sensed temperature.

* * * * *